US006502638B1

(12) United States Patent
Stoesz

(10) Patent No.: US 6,502,638 B1
(45) Date of Patent: Jan. 7, 2003

(54) METHOD FOR IMPROVING PERFORMANCE OF FISHING AND DRILLING JARS IN DEVIATED AND EXTENDED REACH WELL BORES

(75) Inventor: Carl W. Stoesz, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 8 days.

(21) Appl. No.: 09/689,121

(22) Filed: Oct. 12, 2000

Related U.S. Application Data

(60) Provisional application No. 60/160,345, filed on Oct. 19, 1999.

(51) Int. Cl.[7] ..... E21B 31/107; E21B 31/00

(52) U.S. Cl. ..... 166/301; 166/50; 166/177.6; 166/178

(58) Field of Search ..... 166/301, 177.6, 166/178, 50

(56) References Cited

U.S. PATENT DOCUMENTS

| | | | | | |
|---|---|---|---|---|---|
| 3,235,014 | A | * | 2/1966 | Brooks | 173/57 |
| 3,898,815 | A | | 8/1975 | Young | |
| 3,946,819 | A | | 3/1976 | Hipp | |
| 4,111,271 | A | | 9/1978 | Perkins | |
| 4,384,625 | A | | 5/1983 | Roper et al. | |
| 4,462,471 | A | * | 7/1984 | Hipp | 175/296 |
| 4,576,229 | A | * | 3/1986 | Brown | 166/177.6 |
| 4,682,657 | A | * | 7/1987 | Crawford | 166/385 |
| 4,702,325 | A | | 10/1987 | Hipp | |
| 4,890,682 | A | * | 1/1990 | Worrall et al. | 175/106 |
| 5,007,479 | A | | 4/1991 | Pleasants et al. | |
| 5,156,223 | A | * | 10/1992 | Hipp | 173/110 |
| 5,562,170 | A | | 10/1996 | Wolfer et al. | |
| 5,595,244 | A | | 1/1997 | Roberts | |
| 5,722,495 | A | | 3/1998 | Rear | |
| 5,762,142 | A | * | 6/1998 | Connell et al. | 137/614.2 |
| 6,062,324 | A | | 5/2000 | Hipp | |
| 6,152,222 | A | * | 11/2000 | Kyllingstad | 166/177.6 |

FOREIGN PATENT DOCUMENTS

| | | |
|---|---|---|
| EP | 0 245892 | 11/1987 |
| GB | 2261238 A | 5/1993 |
| GB | 2318374 | 4/1998 |
| GB | 2332690 A | 6/1999 |
| GB | 2343465 A | 5/2000 |

* cited by examiner

*Primary Examiner*—Hoang Dang
(74) *Attorney, Agent, or Firm*—Steve Rosenblatt

(57) ABSTRACT

A method for using fishing and drilling jars which require high applied tensile loads in deviated or horizontal well bores is described. The method involves the placement of the string of high frequency vibratory devices that are triggered by flow therethrough. These vibratory devices are placed in the region of the bend or deviation in the well bore. The vibratory forces are applied coincidently with the tensile overpull force so as to fully utilize the applied overpull force at the surface down hole at the jar which is attached to the fish.

12 Claims, 3 Drawing Sheets

METHOD FOR IMPROVING PERFORMANCE OF FISHING AND DRILLING JARS IN DEVIATED AND EXTENDED REACH WELL BORES

This application claims benefit of provisional appln. No. 60/160,345 filed Oct. 19, 1999.

FIELD OF THE INVENTION

The field of this invention relates to techniques for improving the performance of fishing and drilling jars in deviated well bore conditions.

BACKGROUND OF THE INVENTION

The problem addressed by the method of the present invention is illustrated in FIG. 1. Referring to FIG. 1 a deviated well bore 10 is illustrated. The deviated well bore 10 has a 90° bend 12. Further down in the well bore a stuck object or "fish" 14 is located. The fish 14 could be a liner string or a downhole tool. A jar 16 is secured to a tubing string 18 for ultimate attachment to the fish 14. These jars require a significant amount of overpull and are known for their ability to deliver high impact blows to a stuck object. The frequency of the blows is quite low. However the magnitude of the force delivered is a multiple of the overpull force applied which can be in the order of tens of thousands of pounds or more. FIG. 1 readily illustrates the problem when attempting to use this type of jar in the deviated well bore 10. The tubing string 18 makes contact with the wall 20 of the well bore 10. This impedes the degree of overpull that can be applied to the jar 16 and thus moderates the applied impact load to the fish 14 to free it. In essence the frictional forces at the bend 12 acting on the tubing string 18 limit the amount of tension that can be applied to the string 18 which is transmitted to the jar 16.

One approach in the prior art has been to work the tubing string 18 up and down with the draw works at the surface. This technique has had very limited success.

Various high frequency vibratory devices have been used in tandem with rotating bits to promote drilling operations. Such techniques are illustrated in U.S. Pat. Nos. 4,462,471; 4,958,691; 5,156,223. Such high frequency vibratory tools have also been used to release stuck objects in the well bore by being attached directly to the stuck object. When fluid is pumped through such tools vibration ensues and the vibration hopefully frees the stuck object such as a liner string.

The object of the present invention is to alleviate the problems for applications of fishing and drilling jars which rely on significant amounts of applied overpull in deviated or horizontal well bores. Thus the objective of the present invention is to be able to ensure transmission of the applied overpull force at the surface to the jar which is in the deviated or horizontal segment of the well bore. Those skilled in art will readily appreciate how the objective of the method of the present invention is accomplished by a review of the preferred embodiment which appears below.

SUMMARY OF THE INVENTION

A method for using fishing and drilling jars which require high applied tensile loads in deviated or horizontal well bores is described. The method involves the placement of the string of high frequency vibratory devices that are triggered by flow therethrough. These vibratory devices are placed in the region of the bend or deviation in the well bore. The vibratory forces are applied coincidently with the tensile overpull force so as to fully utilize the applied overpull force at the surface down hole at the jar which is attached to the fish.

DETAILED DESCRIPTION OF THE PREFERRED EMBODIMENT

Figure 1:
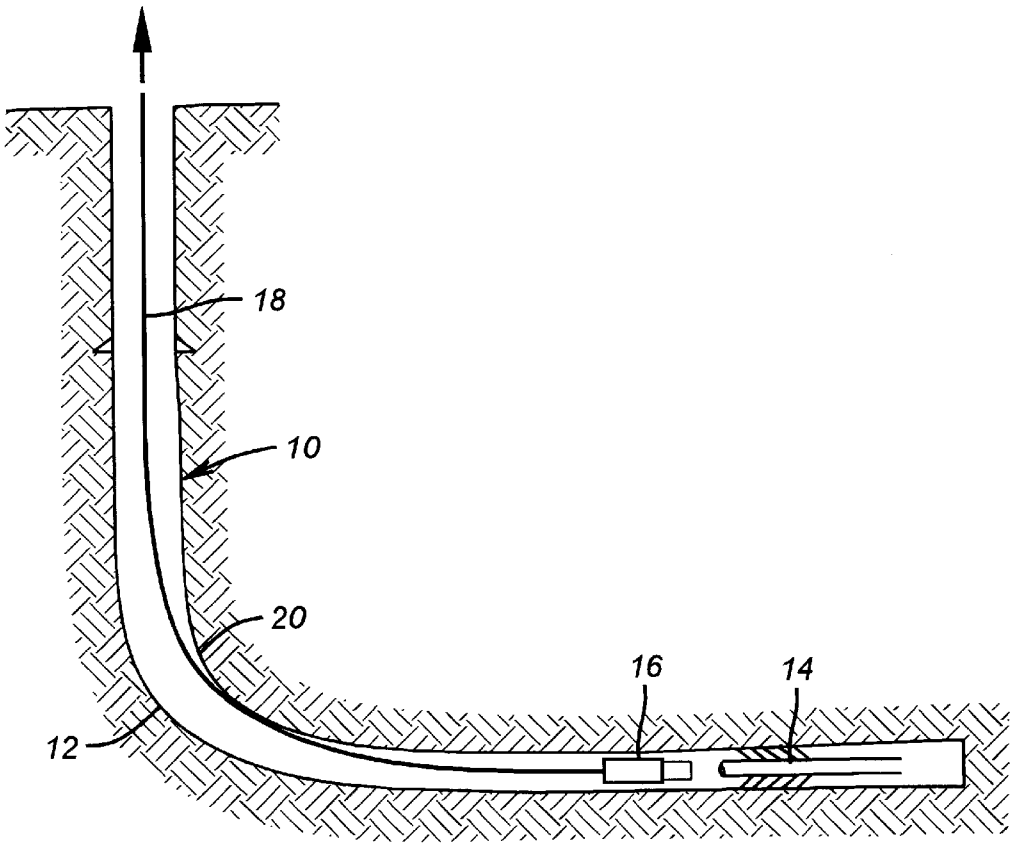
(PRIOR ART) FIG. 1
FIG. 1 is a sectional elevational view of prior art attempts to remove a fish in a deviated well bore using a jar.
Figure 2:
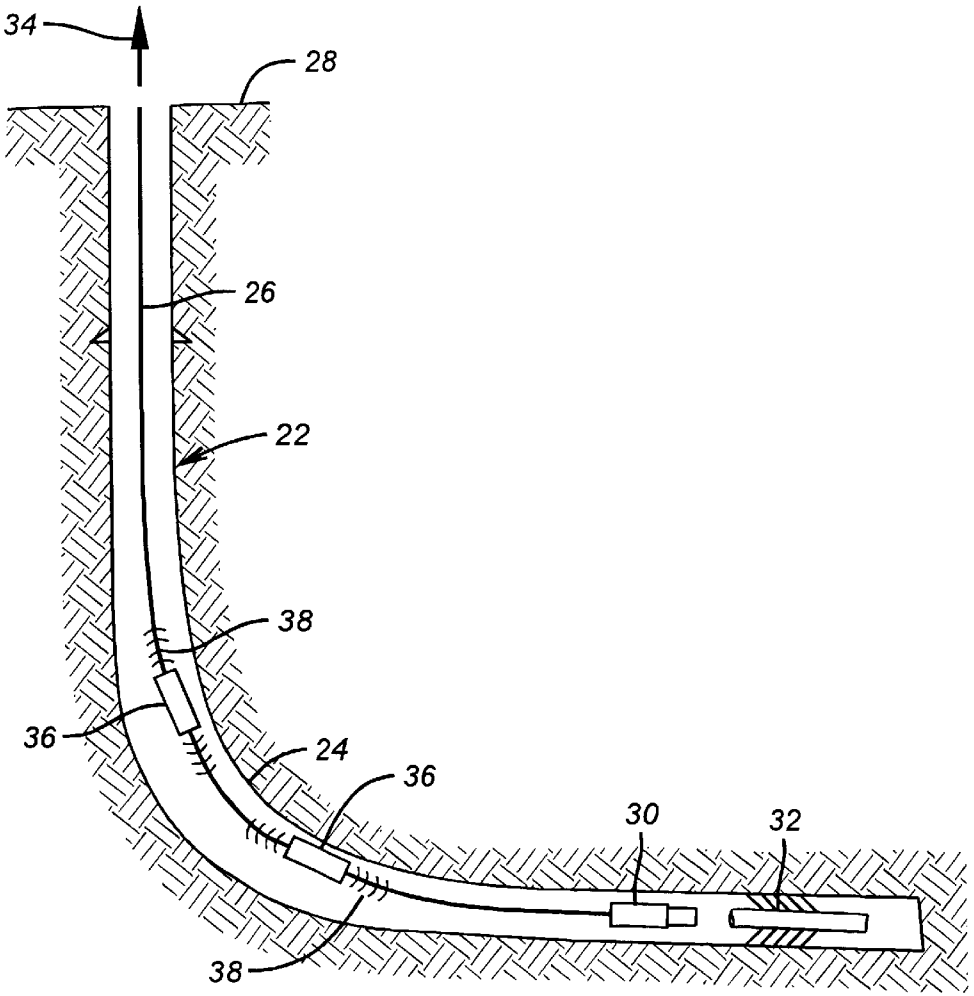
FIG. 2 is a section view of a deviated well bore showing the method of the present invention for removing a stuck fish in a deviated well bore.

Referring to FIG. 2 the well bore 22 has a deviation 24. FIG. 2 is meant to be schematic for deviated as well as horizontal well bores 22. A string 26 extends from the surface 28 to a jar 30. Jar 30 is a type well-known in the art which operates on an overpull tensile force which is ultimately liberated resulting in a magnification of the applied overpull force to attempt to extract a fish or stuck object 32 from the well bore 22. As shown in FIG. 2 the jar 30 has yet to engage the fish 32. Those skilled in art will appreciate that the jar 30 is advanced until it makes a gripping contact with the fish 32 for application of the overpull force represented by arrow 34 for release of the fish 32. Located in the string 26 are one or more vibrators 36. In FIG. 2 they are shown straddling the deviation 24 but they could very well be placed within the deviation. The purpose of the vibrators 36 which are flow actuated to create high frequency vibration illustrated schematically as 38 is to enable the tensile force indicated schematically by arrow 34 to reach the jar 30 so that a maximum tensile force is applied to the jar and subsequently magnified for release of the fish 32. The vibrators 36 reduce the frictional force which drags on the string 26 which can as illustrated in the prior art illustration of FIG. 1 reduce the tensile force which actually reaches the jar 30. The vibrators 36 can be identical or they can be different depending on their placement. Ideally the vibrators 36 should be placed close to the region where the highest frictional resistance is anticipated.

Figure 3:
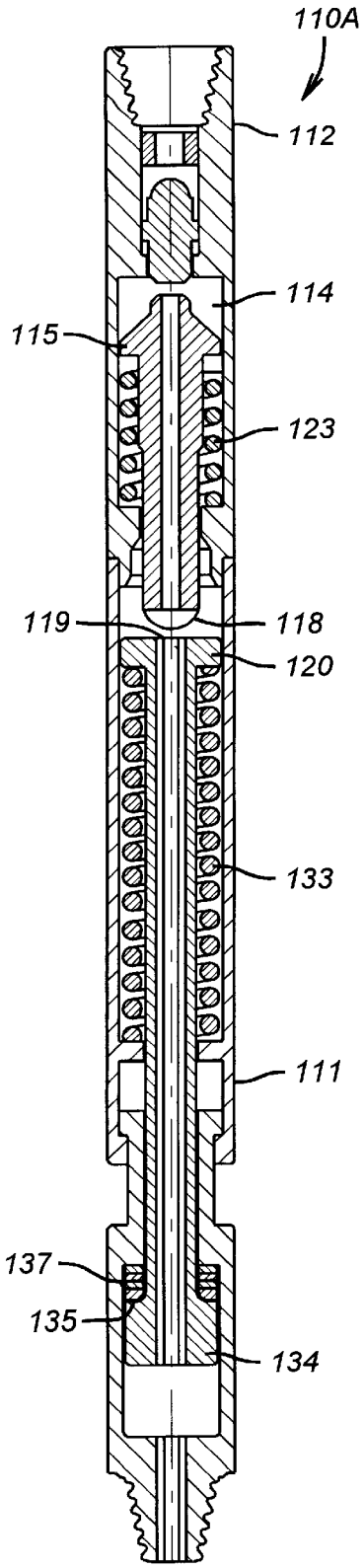
FIG. 3 is a sectional elevational view of a vibratory device which can create high frequency vibrations in a run-in position.
Figure 4:
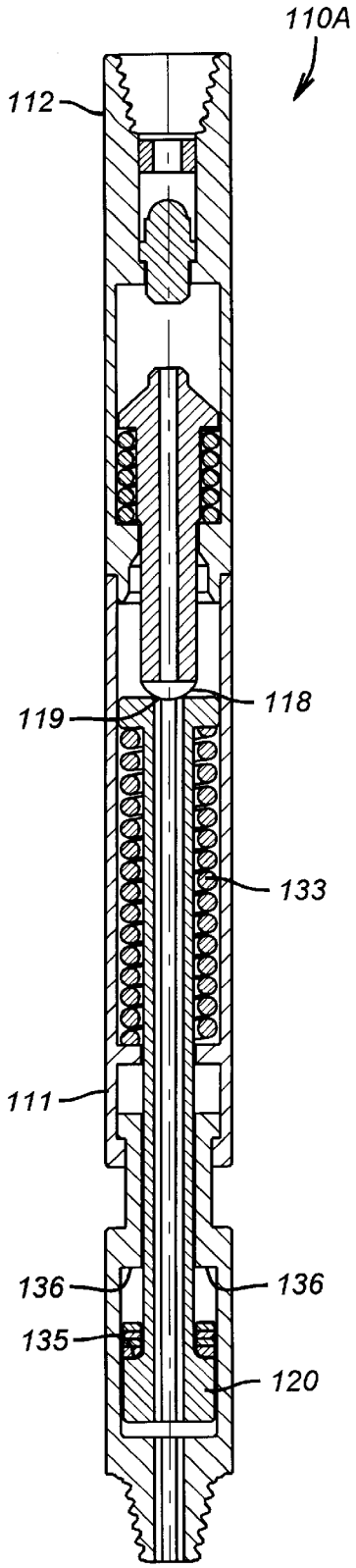
FIG. 4 is a section view of the vibratory device shown in FIG. 3 with flow going through it to create the vibration.

One form of such high frequency vibrators is illustrated in FIGS. 3 and 4. Referring to FIGS. 3 and 4 the vibrator 36 is generally designated by the numeral 110A. The valving member 115 seats at surface 118 when flow through the bore 114 pushes down on the valving member 115. Piston 120 and valving member 115 separate when the upward force building in spring 123 become greater than the force holding the valving member 118 to valve seat 119 thus breaking a seal. Then, valving member 115 moves upwardly urged by spring 123 and piston 120 moves upwardly urged by spring 133. The lower end 134 of piston 120 is enlarged, having an annular shoulder 135 but is shaped to register against and strike annular surface 136 of tool body 111 creating an upward jarring blow. A removable, replaceable shock member 137 forms a shock absorbing interface and lessens the metal fatigue in piston 134 at surface 135 and in housing 111 at surface 136. The annular member 137 is of a material that is softer than the material used to construct piston 120 and housing 111.

Although one embodiment of a high frequency vibration device 36 is illustrated in FIGS. 3 and 4. Those skilled in the art can appreciate that a variety of different flow induced vibration devices can be used without departing from the spirit of the invention. Other types of vibration inducing devices are also within the purview of the invention, whether they are flow actuated, motor driven or have some other external input power source.

Those skilled in the art will now appreciate that in horizontal or deviated well bores where overpull jars are in use, the limitation in the prior art illustrated in FIG. 1 is overcome by the method of the present invention. Frictional forces are reduced if not eliminated by the application of strategically located vibration devices 36 which are preferably stationed close to the deviation where the highest frictional resistance is expected. When combined with a jar 30 attached to a fish 32 the applied force illustrated by arrow 34 can be transmitted directly to the jar 30 without losses in the applied tensile force at the deviation 24. As a result the jar 30 functions as it was intended to and as it would typically be expected to operate in a straight hole.

The present invention may be embodied in other specific forms or techniques without departing from the spirit or essential attributes thereof and, accordingly, reference should be made to the appended claims, rather than the foregoing specification, as indicating the spoke of the invention.

I claim:

1. A method for improving transmission of force applied through a tubing string in a deviated well bore to an object downhole comprising:

extending a tubing string past a well bore deviation toward a fish stick in the well bore;

supporting a jar tool adjacent a lower end of said tubing string;

engaging the jar tool to the fish;

locating at least one vibrating device, on said tubing string and at or near said deviation when said jar tool is disposed downhole from the deviation;

applying an over-pull tensile force to activate said jar tool;

minimizing resistance to said over-pull tensile force experienced in said deviation due to said vibrating device.

2. The method of claim 1, comprising:

using a flow induced vibration device as said vibration device.

3. The method of claim 2, comprising:

providing axially oriented vibration to said string.

4. A method for improving transmission of force applied through a tubing string in a deviated well bore to an object downhole comprising:

locating a tubing string through a well bore deviation;

supporting a jar tool disposed downhole from the deviation on said tubing string; engaging the object with said jar tool;

using a plurality of vibrating devices placed to straddle the deviation;

allowing an over-pull tensile force to be transmitted to the object beyond said deviation due to said vibrating devices.

5. A method for improving transmission of force applied through a tubing string in a deviated well bore to an object downhole comprising:

locating a tubing string through a well bore deviation;

supporting a jar tool disposed downhole from the deviation on said tubing string;

engaging said jar tool to the object;

applying a tensile over-pull force to said string;

using at least one vibrating device to minimize resistance experienced in said deviation due to said over-pull force applied to said string.

6. A system for reducing drag on a tubular string extending through a well bore deviation comprising:

a tubular string supporting a jar tool adjacent a lower end thereof for engaging a fish stuck in a wellbore below a deviation;

at least one vibrator mounted on the string away from said jar tool and in a location where said vibrator will be disposed at or adjacent a deviation in a wellbore when said jar tool is engaged to the fish, to axially vibrate said tubing string in the vicinity of the well deviation, thereby allowing an over-pull tensile force to be communicated to said jar tool through said deviation.

7. The system of claim 8, wherein;

said vibrator is responsive to flow therethrough to create axial vibration.

8. The system of claim 6, wherein:

a plurality of said vibrators are mounted to straddle the deviation in the string.

9. A system for reducing drag on a tubular string extending through a well bore deviation comprising:

a tubular string supporting a tool adjacent a lower end thereof;

at least one vibrator, responsive to flow therethrough to create axial vibration and mounted on the string away from said tool and in a location where said vibrator will be disposed at or adjacent a deviation in a wellbore when said tubing string is positioned in the wellbore, to axially vibrate said tubing string in the vicinity of the well deviation, thereby minimizing resistance to movement of said string when operating said tool beyond said deviation;

said vibrator further comprising a vibrator housing and a plurality of pistons selectively movable in tandem.

10. The system of claim 9, wherein:

said plurality of pistons comprise an upper and a lower piston;

said pistons are biased in the same direction;

said vibrator housing contains an anvil which is impacted by a hammer mounted on said lower piston.

11. The system of claim 10, wherein:

said upper and lower pistons are respectively biased by an upper and a lower spring;

said pistons have a bore therethrough to allow flow to pass through said vibrator housing;

whereupon flow through said bores moves said piston in tandem until said upper spring moves said upper piston away from said lower piston to allow said lower spring to bias said hammer to impact said anvil, by moving said lower piston toward said upper piston.

12. The system of claim 11, wherein:

a plurality of said vibrators are mounted to straddle the deviation in the string.

* * * * *